US007643381B2

(12) United States Patent
Sigelmann

(10) Patent No.: US 7,643,381 B2
(45) Date of Patent: Jan. 5, 2010

(54) ONE-MOVEMENT BALANCED HANDS CLOCK

(76) Inventor: Rubens A. Sigelmann, 13214 - 35th Ave., NE., Seattle, WA (US) 98125

( * ) Notice: Subject to any disclaimer, the term of this patent is extended or adjusted under 35 U.S.C. 154(b) by 0 days.

(21) Appl. No.: 12/018,798

(22) Filed: Jan. 23, 2008

(65) Prior Publication Data

US 2009/0185457 A1 Jul. 23, 2009

(51) Int. Cl.
*G04B 19/04* (2006.01)

(52) U.S. Cl. ..... 368/81; 368/220; 368/238

(58) Field of Classification Search ..... 368/185, 368/203, 80–81, 141–154, 238
See application file for complete search history.

(56) References Cited

U.S. PATENT DOCUMENTS

| | | | | |
|---|---|---|---|---|
| 78,972 A | | 6/1868 | King | |
| 407,945 A | * | 7/1889 | Speer | 368/81 |
| 517,594 A | * | 4/1894 | Smith | 368/81 |
| 940,617 A | * | 11/1909 | Saloch | 368/81 |
| 1,107,947 A | * | 8/1914 | Hicks | 368/81 |
| 2,639,577 A | * | 5/1953 | Lubin | 368/81 |
| 2,642,713 A | | 6/1953 | Prins | |
| 3,668,858 A | * | 6/1972 | Hartwig | 368/77 |
| 4,090,351 A | * | 5/1978 | Foreman, Jr. | 368/185 |
| 7,359,289 B2 | * | 4/2008 | Saunier | 368/229 |

OTHER PUBLICATIONS

Sigelmann, Rubens A., The Balanced-Independent-Hand Clock:, The National Association of Watch and Clock Collectors, Inc. ("NWACC") Bulletin, pp. 177-182, Apr. 2002.
NAWACC Bulletin, Aug. 2002, vol. 44/4, No. 339, p. 535.

* cited by examiner

*Primary Examiner*—Renee Iuebke
*Assistant Examiner*—Sean Kayes
(74) *Attorney, Agent, or Firm*—R. Reams Goodloe, Jr.

(57) ABSTRACT

A balanced hands clock. The clock utilizes a single movement, which movement may be located in the minute hand. A gear drive mechanism provides leverage from said movement via a first pivot shaft to drive the hour hand. The clock is mounted in a base for time indicating movement. Covers may be provided to hide the single movement and the gear mechanism, so that no visible drive configuration is visible to an observer.

30 Claims, 11 Drawing Sheets

42
30
34
GR
48
132
L3
32
82
50
52
46
134
44
L4
54
58
56
BL 106
90
92
94
54
72R
72O
72
52
50
120
126
104
82
46
32
74
86
70
61
156
64
154
158
66
152
150
88
160
76
80
62
78
110
144
146
148
48
142
130
140
44S
44
44₁
44₂
30

ONE-MOVEMENT BALANCED HANDS CLOCK

COPYRIGHT NOTICE

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This invention relates to clocks, and more particularly, to clocks utilizing balanced hands, and in one embodiment such clocks as are further designed for display in a manner wherein the drive mechanism remains unseen by an observer.

BACKGROUND

In the art of building "mystery clocks", drive mechanisms may or may not be visible. However, in "mystery clocks" the driving mechanisms are intentionally designed to impede the unwary observer when trying to understand how the drive actually functions.

A few clocks with two independent balanced hands have been built in the past. Some of the basic principles utilized in the design and operation of balanced hand clocks are described in an article entitled "The Balanced-Independent-Hand Clock", by Rubens A. Sigelmann, The National Association of Watch and Clock Collectors, Inc. ("NAWCC") Bulletin, Vol. 44/2, pages 177-182, April, 2002. The basic principles as previously known in the art are illustrated in FIGS. 1 and 2. One type of a balanced-hand for a clock can be represented by the simplified illustration provided in FIG. 1. The balanced hand 10 is represented as extending between (a) a center of mass $m_1$ located for reference purposes as at the pointing end 12 of indicating arrow 14, and (b) a center of mass $m_2$ situated for reference purposes at location identified by reference numeral 16. The balanced hand 10 is suspended from, and rotates freely around, a pivot axis 18. The mass $m_1$ represents all the mass above the point of suspension or pivot axis 18. Distance $I_1$ represents the distance between the center of mass for mass $m_1$ and the point of suspension at pivot axis 18. Similarly, $m_2$ represents all mass, except for mass $m_3$ discussed below, below the point of suspension and pivot axis 18. Distance $I_2$ represents the distance between the center of mass for mass $m_2$ and the point of suspension at pivot axis 18. Also as indicated in FIG. 1, the mass $m_3$ rotates along a circle 20 of radius r.

Referring now to FIG. 1, consider the case when mass $m_3$ rotates by an angle beta (β) in the counterclockwise direction. Due to the force of gravity GR as indicated downward along reference line 22, the new position of the balanced hand 10 is given by the angle alpha (α) from the vertical reference line 22. A balanced hand exhibits no eccentricity if, when the angle beta (β) is equal to zero (0), the balanced hand aligns along the gravity direction of reference line 22, as shown in FIG. 1. Thus, for a balanced hand without eccentricity the angles alpha (α) and beta (β) are related by the equation [1]:

$$m_1 l_1 \sin(\alpha)=(m_2+m_3)l_2 \sin(\alpha)+m_3 r \sin(\alpha-\beta)$$

Thus, as described by the equation [1], in the event that the mass and distance balance relationships of the balanced hand is described by the equation [2] below $$m_1 l_1=(m_2+m_3)l_2$$

then the only way the equation may be satisfied is if the angle alpha (α) equals the angle beta (β). This is the condition for the balanced hand being balanced. Consequently, in a precisely balanced hand, when the mass $m_3$ rotates a prescribed angle beta (β) in the counterclockwise direction about the movement axis at 16 of movement 17, the balanced hand rotates exactly the equivalent angle alpha (α) in the clockwise direction about the pivot axis 18.

Prior art clocks as described in the article noted above utilize two independent balanced hands, namely, one for the minute hand and one for the hour hand. In those clocks, a quartz movement drives a mass $m_3$ in each of the balanced hands. However, in such prior art clocks, the minute balanced hand mass $m_3$ (minute) is attached to the axle 16 of the movement in the minute hand 10, and a the hour balanced hand mass $m_3$ (hour) is attached to an axle of the movement in an hour hand, with construction similar to that shown for the minute hand depicted in the prior art minute hand design depicted in FIGS. 1 and 2.

SUMMARY

I have now developed a one-movement balanced hands clock. The clock has a body, and a first pivot shaft rotatably supported by and extending from the body. A balanced minute hand is secured to, and rotates with, the first pivot shaft. In an embodiment, the balanced minute hand is securely affixed to, and turns with, the first pivot shaft. The balanced minute hand has a single clock movement provided as a component thereof. The single clock movement includes one rotating mass in the minute hand, and one rotating mass in the hour hand. The minute hand is operably balanced about the first pivot shaft. A balanced hour hand is provided, and it is also operably balanced about the first pivot shaft. The balanced hour hand is movable respect to the minute hand, and is operable by the minute hand through a drive mechanism so that the minute hand rotatably operates the hour hand about the first pivot shaft. The drive mechanism includes a first gear that is provided with, and as a part of, the balanced hour hand. The drive mechanism also includes a second gear that rotates in concert with the first pivot shaft, and in an embodiment, is detachably affixed to the first pivot shaft at a selected operating location.

The first gear also is provided with a first gear mass at a selected first gear orientation position, and in an embodiment, the first gear mass biases the selected first gear orientation downward in the direction of gravity forces, i.e., the first gear mass continually tugs the first gear so that the first gear remains, or more precisely, moves in response to movement of the second gear, toward a position where the first gear orientation position is such that the first gear mass is downward, in the gravity direction. In an embodiment, the first gear and the second gear each are toothed gears. In such a configuration, the gear ratio R, being the number of teeth in said first gear divided by the number of teeth in said second gear, is eleven (11). In an embodiment, a gear housing is provided and the first pivot shaft is journaled for rotary movement within said gear housing. One configuration for journaling by the gear housing is to provide a first pair of ball bearings, where the first pair of ball bearings is sized and shaped for accommodating the first pivot shaft and is adapted to provide friction minimizing passage of the first pivot shaft through the gear housing. The hour hand includes a baseplate and a second pivot shaft. In an embodiment, the second pivot shaft is fixedly secured to the baseplate. The second pivot shaft is journaled for rotary movement of the first gear about the second pivot shaft, i.e. the first gear freely turns on the second pivot shaft. A first gear bearing is provided for journaling of the second pivot shaft, and in an embodiment, the first gear bearing may be a ball bearing.

In an embodiment, the balanced hour hand and the balanced minute hand may each have arms that extend outward to a distal end. Each of the balanced hour hand and the balanced minute hand may also include balancing weights, i.e., a suitable mass that is sized and shaped for being adjustably secured, with respect to the center of mass of the balancing weight, at a suitable balancing location $B_L$ along the length of the respective balanced hour hand arm or balanced minute hand arm. One useful embodiment is to provide the respective arms in a long generally round or cylindrical shape, and to provide the respective balancing weights in an annular cylindrical shape of complementary size, shape, and suitable weight. Adjustment mechanisms may also be provided to avoid eccentricity.

The foregoing briefly describes a one-movement balanced hands clock. The various objectives, features and advantages of the invention will be more readily understood upon consideration of the following detailed description, taken in conjunction with careful examination of the accompanying figures of the drawing.

BRIEF DESCRIPTION OF DRAWING

In order to enable the reader to attain a more complete appreciation of the invention, and of the novel features and advantages thereof, attention is directed to the following detailed description when considered in connection with the accompanying drawings, wherein.

Figure 1:
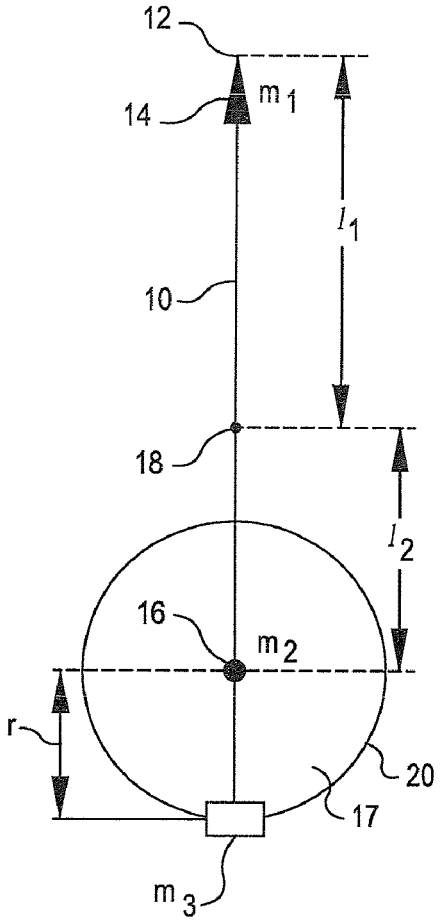
FIG. 1 PRIOR ART
FIG. 1 provides a schematic representation of a prior art balanced hand clock component, when the balanced hand is aligned vertically.
Figure 2:
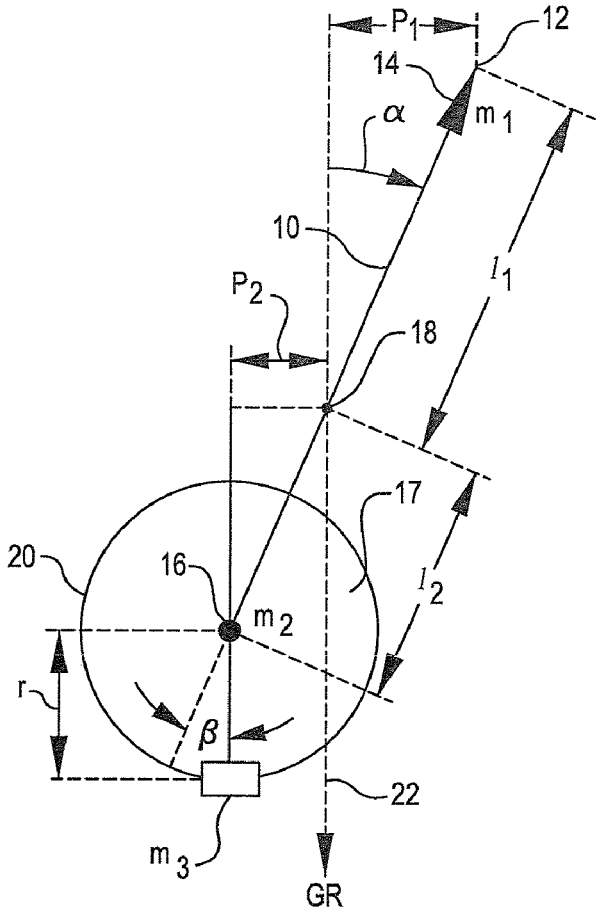
FIG. 2 PRIOR ART
FIG. 2 provides a schematic representation of a prior art balanced hand clock component, when the balanced hand has rotated clockwise by an angle alpha ($\alpha$).

In the various figures of the drawing, like features may be illustrated with the same reference numerals, without further mention thereof. Further, the foregoing figures are merely exemplary, and may contain various elements that might be present or omitted from actual implementations of various embodiments depending upon the circumstances. An attempt has been made to draw the figures in a way that illustrates at least those elements that are significant for an understanding of the various embodiments and aspects of the invention. However, various other elements of a one movement balanced hands clock, especially as applied for different variations of the functional components illustrated, as well as different embodiments of artistic elements such as a shape of components or visual design of various elements, may be utilized in order to provide a useful, reliable, visually attractive and intellectually challenging timepiece.

DETAILED DESCRIPTION

Figure 3:
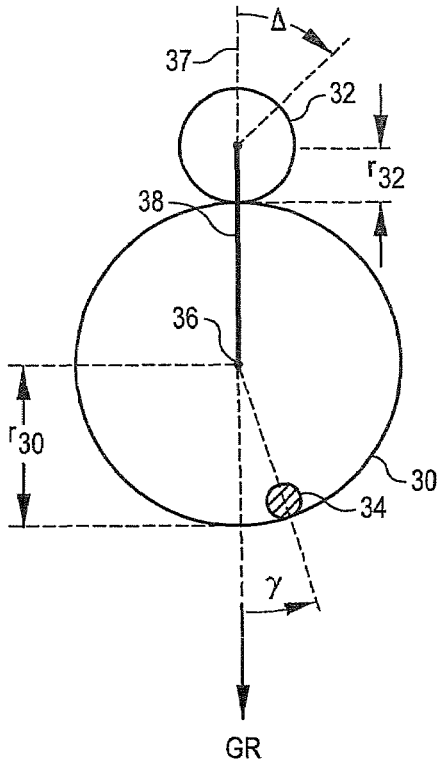
FIG. 3 provides a schematic representation of a design for an hour hand for a one-movement balanced hands clock, when the balanced hand is aligned vertically.
Figure 4:
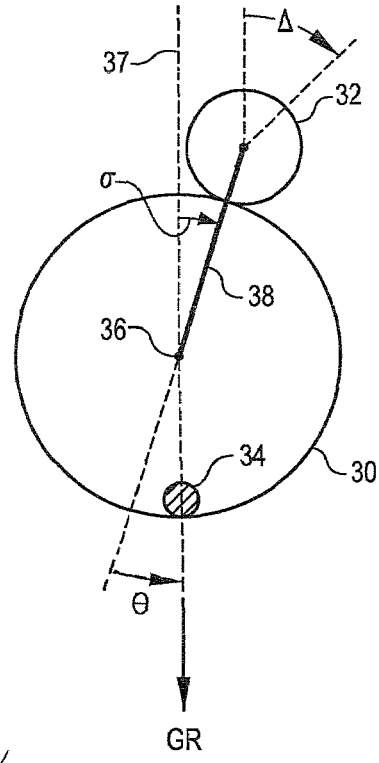
FIG. 4 provides a schematic representation of a design for an hour hand for a one-movement balanced hands clock, when the balanced hand has rotated clockwise by an angle sigma ($\sigma$).
Figure 5:
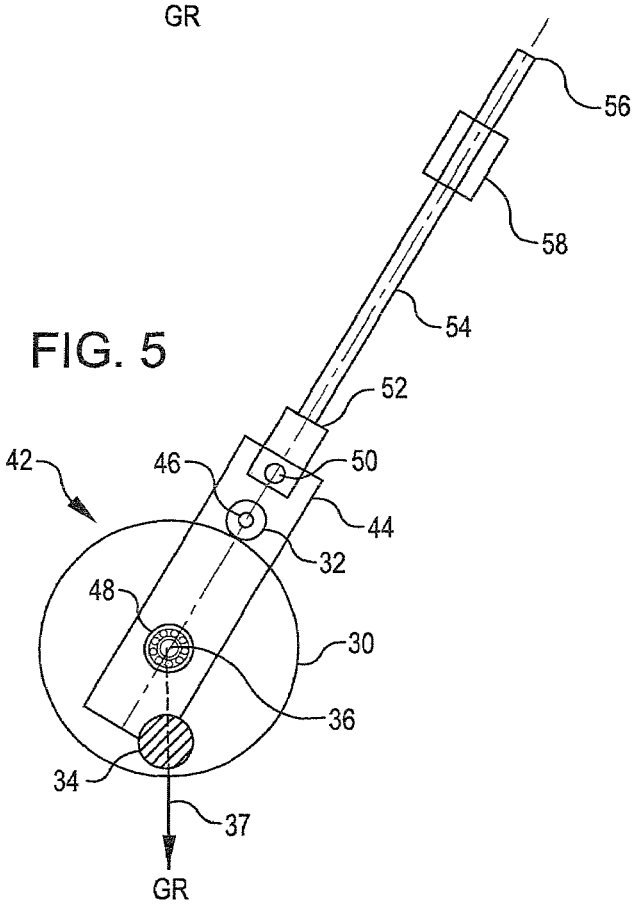
FIG. 5 provides a detailed schematic of an exemplary design for an hour hand for a one-movement balanced hands clock, when the balanced hand has rotated by an angle sigma ($\sigma$).

Attention is directed to FIGS. 3, 4, and 5 of the drawing, which depict certain aspects of novel design concepts useful for a one-movement balanced hands clock. These FIGS. 3, 4, and 5 provide basics for a understanding the structure of an hour hand for a balanced hand clock. First gear 30 and second gear 32 are placed in responsive proximity each to the other. First gear 30 and second gear 32 are related by a gear ratio R. In the case of toothed gears, R is the ratio of the number of teeth $G_1$ in first gear 30 divided by the number of teeth $G_2$ in second gear 32. For conventional clocks, the minute hand travels twelve (12) times faster than the hour hand of the clock, and thus this relationship must be observed in determining the number of teeth in each of the first gear 30 and second gear 32 that result the gear ratio R. In any event, the radius $r_{30}$ of first gear 30 and the radius $r_{32}$ of the second gear 32, as indicated for an embodiment in FIG. 3, as well as the number of teeth in each of the first gear 30 and second gear 32, must be taken into account by the clock maker.

First gear 30 has provided therewith a mass 34 that biases the position of first gear 30 so that the mass 34 is located in the gravity GR direction from the center of rotation 36 of first gear 30. When second gear 32 is rotated an angle delta (Δ) in the clockwise direction, then first gear 30 rotates an angle gamma (γ) in the counterclockwise direction. The angle gamma (γ) is equal to the angle delta (Δ) divided by the gear ratio R.

Because the balanced hour hand represented by length 38 rotates an angle sigma (σ) in the clockwise direction, mass 34 rotates an angle sigma (σ) divided by the gear ratio R in the clockwise direction (specifically, σ/R). As shown in FIG. 4, the angle theta (θ) is the result of the contributions of two angles, one due to the rotation delta (Δ) of the second gear 32 in the counterclockwise direction, and the other due to the rotation sigma (σ) in the clockwise direction.

As seen in FIG. 4, since the angle theta (θ) and the angle sigma (σ) as a result of these two motions are identical, the relationship of such motion may be determined. Angle theta (θ) equals angle delta (Δ) divided by R less angle sigma (σ) divided by R, according to equation [3]:

$$\sigma = \frac{\Delta}{R} - \frac{\sigma}{R} \qquad [3]$$

FIG. 4 clearly shows that angle theta (θ) equals angle sigma (σ). Since angle delta (Δ) is the angle of the minute hand and angle sigma (σ) is the resultant angle of the hour hand, according to the equation [4]:

$$\Delta = 12\sigma \qquad [4]$$

Figure 6:
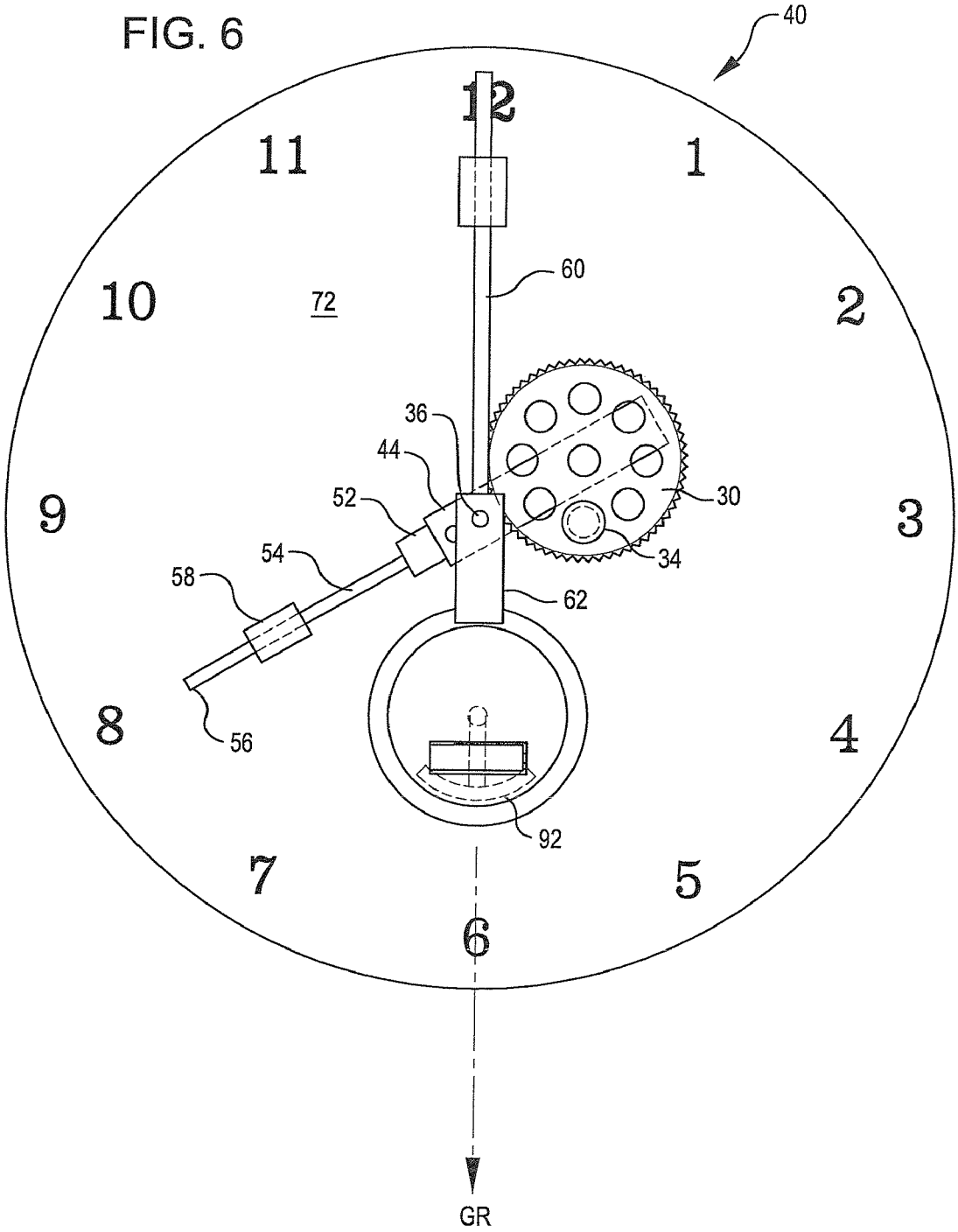
FIG. 6 provides a side elevation view of one-movement balanced hands clock, without any cover on the key components, so that the reader my appreciate the operational components and their basic relationship.

Consequently, by substituting values in the above equation [3] it is concluded that R=11. In this manner, the gear drive relationship of a suitable first gear 30 and a second gear 32 for use in a one-movement balanced hands clock 40 such as illustrated in FIG. 6, may be determined.

Turning now to FIG. 5, a suitable embodiment is conceptually depicted for a balanced hour hand 42 that functions as just described above in relation to FIGS. 3 and 4. The balanced hour hand 42 includes first gear 30 that is pivotally attached to a baseplate 44. First gear 30 is provided with first gear mass 34 for use in biasing the first gear mass 34 downward in the direction of gravity, and thus, biasing the first gear 30 in such an orientation. At the center of rotation 36 of first gear 30, a bearing, such as a ball bearing assembly 48, may be provided, to minimize or eliminate friction to the extent possible as first gear 30 turns with respect to baseplate 44, as will be further described herein below. A fastener such as screw 50 is used to affix hour arm mount 52 to baseplate 44. The hour arm 54 extends from hour arm mount 52 to a distal end 56. In one embodiment, a balancing weight 58 may be adjustably affixed to hour arm 54. In an embodiment, the balancing weight 58 may be provided in an annular cylindrical form having an interior diameter 59 (see FIG. 11) sized and shaped to allow a cylindrically shaped hour arm 54 to slidably fit therethrough, and wherein the balancing weight 58 may be adjustably secured to the hour arm 54. As noted in FIG. 12, the center of balance $B_L$ of balancing weight 58 may be located a distance $L_4$ from the first pivot shaft 46. The center of rotation of first gear 30 is a distance $L_3$ from the first pivot shaft 46. The balancing weight 58 is adjusted along a portion of the length $L_4$ to provide a balanced hour arm 54.

Figure 9:
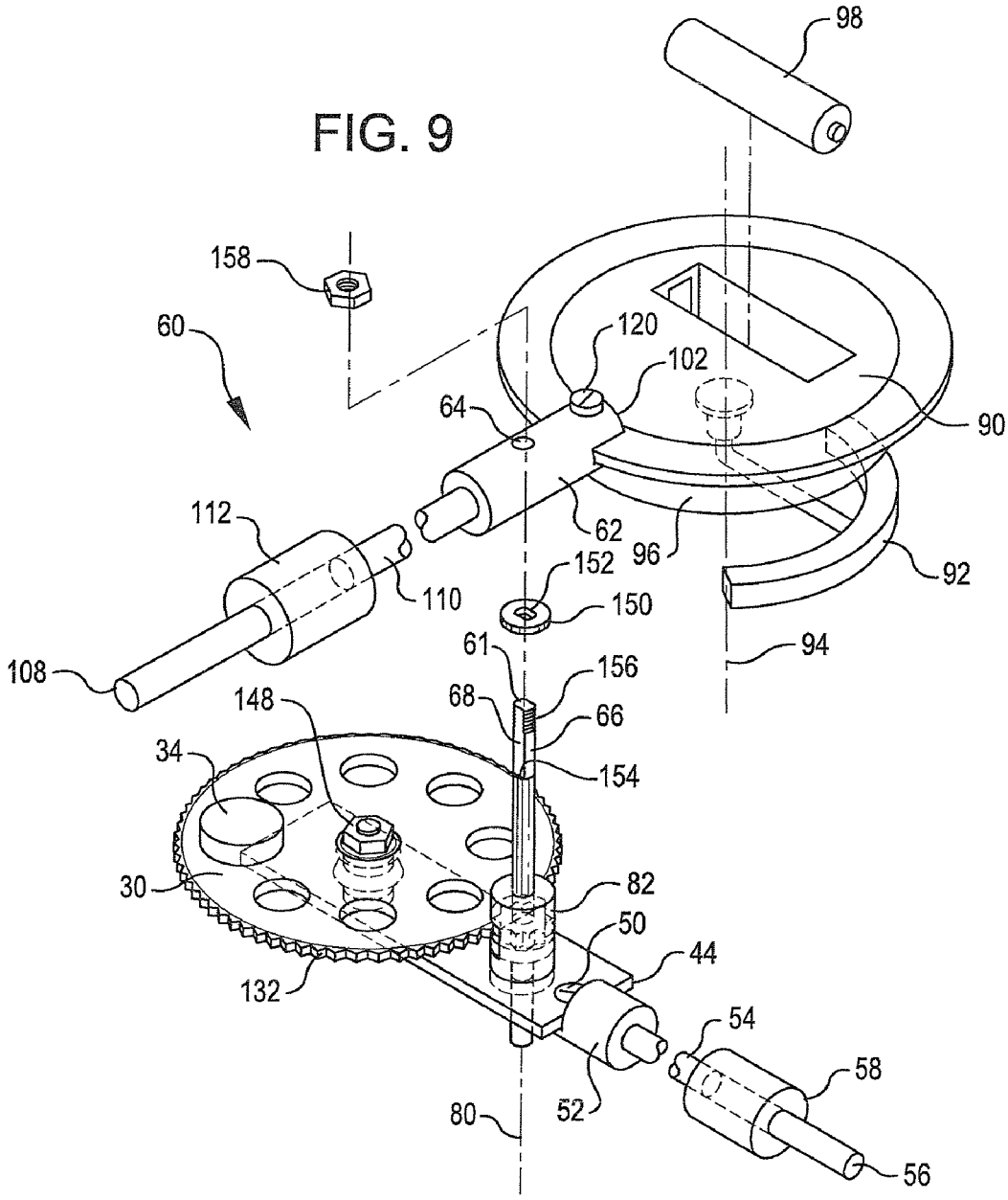
FIG. 9 is an exploded perspective view of various components of a one-movement balanced hands clock, showing the minute balanced hand and the hour balanced hand, in a representative operational relationship similar to that just depicted in FIG. 7 above.
Figure 10:
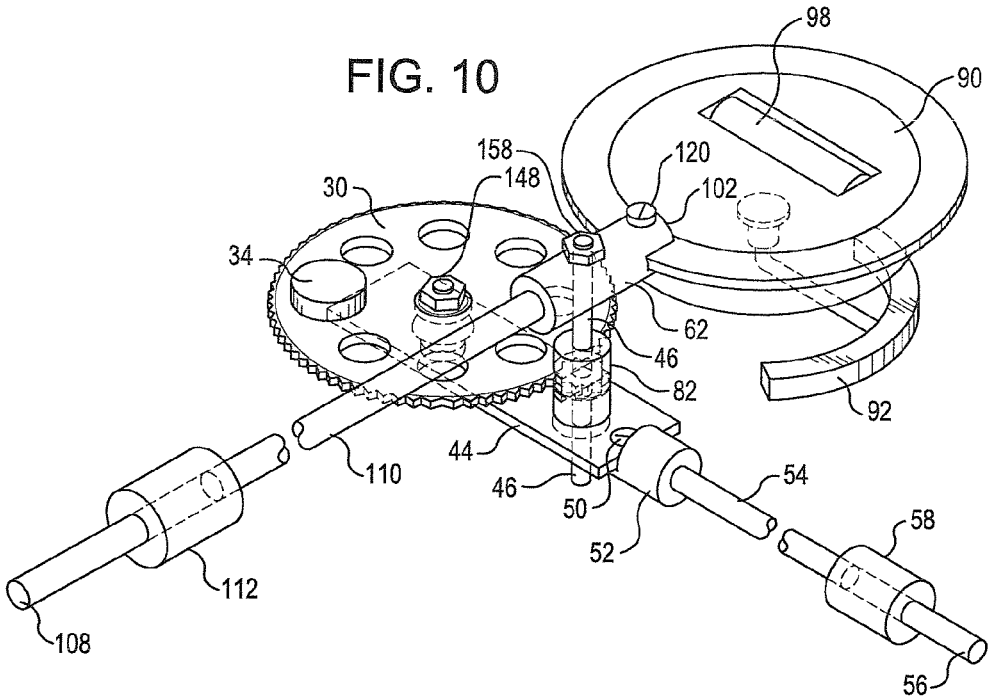
FIG. 10 is a perspective view of various components of a one-movement balanced hands clock, showing the minute balanced hand and the hour balanced hand, the interrelated operational components, and the working relationship between the minute hand and the hour hand.
Figure 13:
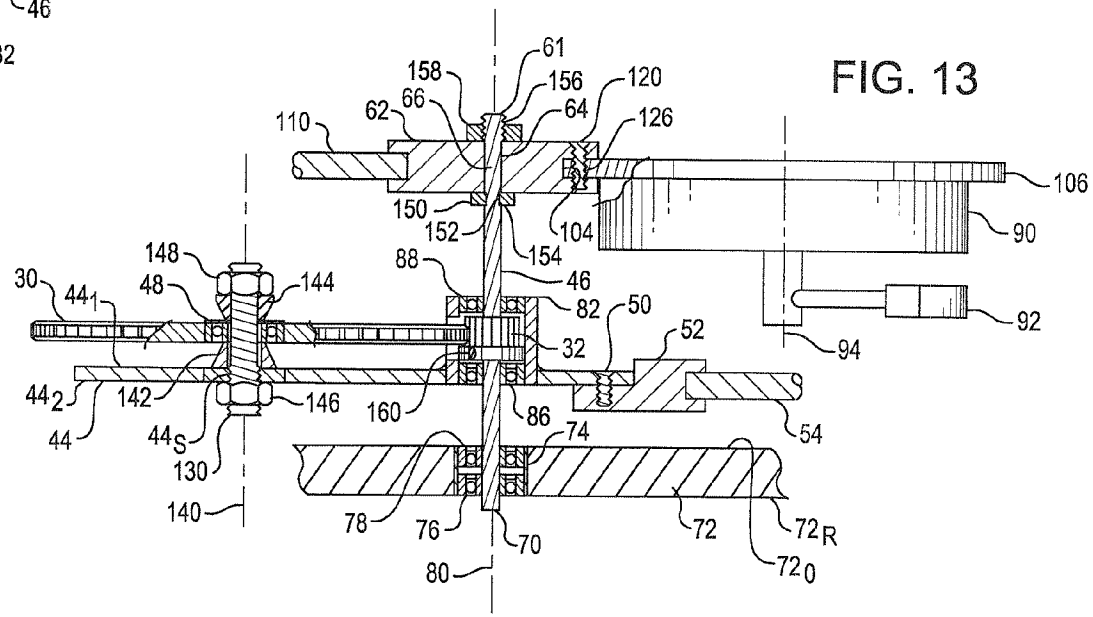
FIG. 13 is a partial cross-sectional view, taken looking down at various components, with the section being taken along the pivot axis of the clock at the point of insertion of the first pivot shaft axis into the base.

As best seen in FIG. 13, but also noted in FIGS. 9 and 10, for an embodiment of a one-movement balanced hands clock, the balanced minute hand 60 does not rotate freely around the first pivot shaft 46 that is its point of suspension. Instead, the balanced minute hand 60 is rigidly connected to the first pivot shaft 46, which in the embodiment shown in FIG. 13, is at or near the external end 61 of first pivot shaft 46. As shown, a minute hand connector 62 is provided, having an aperture 64 therethrough to accommodate an extended portion 66 of the first pivot shaft 46. As seen in FIG. 9, the extended portion 66 may be provided with anti-rotation features 68 and in such case aperture 64 may be provided accordingly in complementary shape.

As also shown in FIG. 13, at or near the internal extremity 70 of first pivot shaft 46, the first pivot shaft 46 is journaled for rotation with respect to the base 72 within a bearing mount 74. As indicated in FIG. 13, base 72 may have an obverse side $72_O$ and a reverse side $72_R$, and in case of a visually transparent base 72, location of balanced minute hand 60 and balanced hour hand 42 with respect thereto is a matter of choice for the clock builder. A pair of ball bearings 76 and 78 may be provided as illustrated in FIG. 13. A pair of ball bearings 76 and 78 or other suitable rotating suspension mechanism should be provided to prevent wobbling of the first pivot shaft 46 along axis 80 as the balanced minute hand 60 and the balanced hour hand 42 rotate.

Rotation of the balanced minute hand 60 is coupled to the balanced hour hand 42 by interaction of the second gear 32, which is fixed to the first pivot shaft 46, with the first gear 30. The first gear 30 is free to rotate as may be provided by ball bearing 48 attached to the baseplate 44 of the balanced hour hand 42. In an embodiment, the first gear 30 has provided therewith a first gear mass 34 to bias the first gear 30 at a selected first gear orientation position, which as illustrated herein, may be where the first gear mass 34 is biased downward toward the gravity direction GR. Thus as shown, this maintains or moves the first gear 30 so that the first gear mass 34 remains downward toward the gravity GR direction as second gear 32 orbits around the first gear 30.

Additionally, as shown in FIG. 13, the balanced hour hand 42 includes a journal assembly 82, here shown extending from baseplate 44, for rotation of the balanced hour hand 42 about first pivot shaft 46. In the embodiment illustrated, the journal assembly 82 includes ball bearings 86 and 88 to allow the balanced hour hand 42 to rotate freely around the first pivot shaft 46. In an embodiment, a pair of hour hand ball bearings 86 and 88 is provided to avoid wobbling of the balanced hour hand 42.

Attention is drawn to FIGS. 9 and 10, where, in FIG. 9, a partially exploded view reveals certain components of the balanced minute hand 60. A single movement 90 is provided. Mass 92 is attached to the movement 90 and is pivotally attached thereto for movement along movement axle 94. A movement housing 96 houses the movement 90. When a quartz type electronic movement is utilized, a battery 98 is provided to power the movement 90, and more specifically, the movement of mass 92 about the movement axle 94. Alternately, a mechanical movement may be provided. Use of an electronic movement or of a mechanical movement is a matter of choice for the clock builder. Electronic movement is usually preferable because its center of mass does not change during operation. However, in mechanical movements, as a spring unwinds, such movement results in a change in the center of mass of the movement, and thus may require adjustment.

Figure 11:
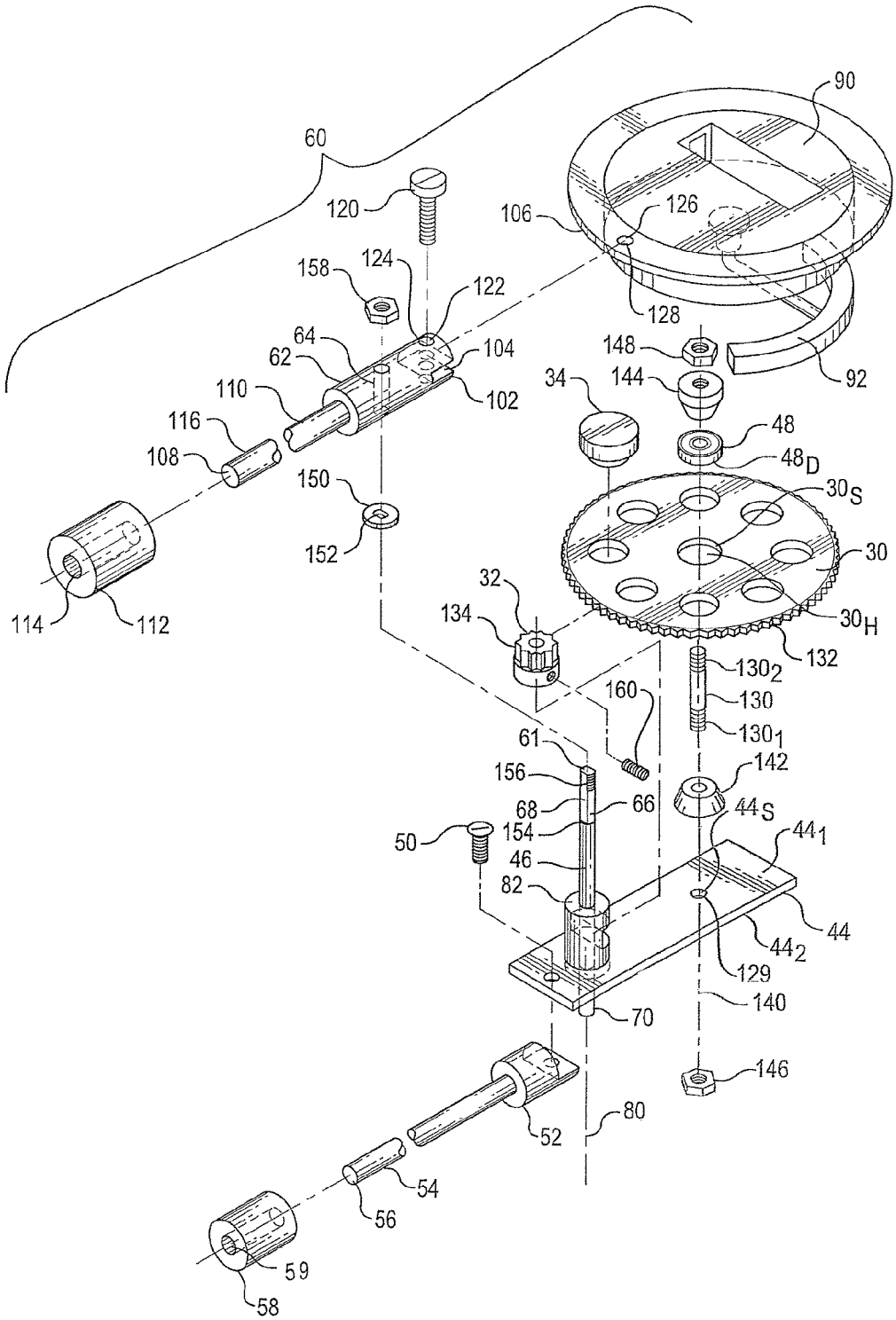
FIG. 11 is an exploded perspective view of various components of a one-movement balanced hands clock, similar to FIG. 9 above, but now showing further details of the various components that may be utilized to assemble one embodiment, and showing the minute balanced hand and the hour balanced hand, and the interrelated operational components and their working relationship.
Figure 12:
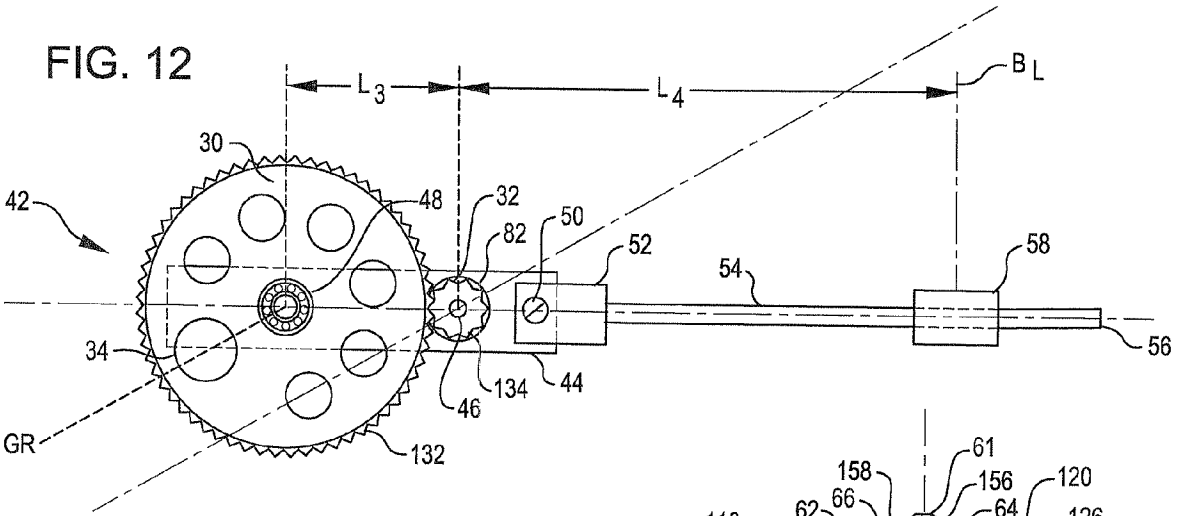
FIG. 12 is a side elevation view of an hour balanced hand, showing a toothed gear situated for movement about a ball bearing, and the indicating arm attached to the toothed gear, as well as a balance mass on the arm.

Attention is directed to FIG. 11, where a minute hand connector 62 is shown connecting the remaining components of the balanced minute hand 60 to the movement housing 96 (see FIG. 9). In an embodiment, at the movement end 102 of minute hand connector 62, a U-shaped receiving slot 104 is provided for insertion of flange 106 of the movement housing 96 therein, for secure connection therebetween.

Extending outward from minute hand connector 62 to a minute hand distal end 108 is minute arm 110. A minute hand balancing weight 112 is provided at a selected location along minute arm 110. In one embodiment, the minute arm 110 may be provided in a generally round or cylindrical shape, and the minute hand balancing weight 112 may be provided an annular cylindrical shape having an inside diameter 114 sized and shaped for mating engagement with the outer surface 116 of minute arm 110.

In one embodiment, the connector 62 attaches to movement housing 96 and is fixed using screw 120. The configuration just described is useful during assembly, in that in order to eliminate any eccentricity the connector 62 may be slightly adjusted by rotating connector 62 a small angle one way or the other, and then fixing it in place with respect to movement housing 96, to assemble the balanced minute hand 60. Such adjustment is advantageously done with the balanced minute hand 60 indicating either twelve (12) o'clock or six (6) o'clock. FIG. 6 illustrates such a position with respect to the balanced minute hand 60. Thus, adjustment is achieved when the movement mass 92 and the balanced minute hand 60 are aligned with the direction GR of gravity. When the just described adjustment is completed, the screw 120 is tightened (in receiving threads 122 in receiving bore 124 of connector 62 and/or threads 126 in receiving bore 128 in flange 106 to secure the connector 62 in a selected configuration. Adjustment to eliminate eccentricity of the balanced hour hand 42 is accomplished by a similar procedure, as respects the adjustment between baseplate 44 and hour arm mount 52, and ultimate fixing of a suitable position by screw 50, as may be better appreciated by reference to FIG. 11.

Figure 7:
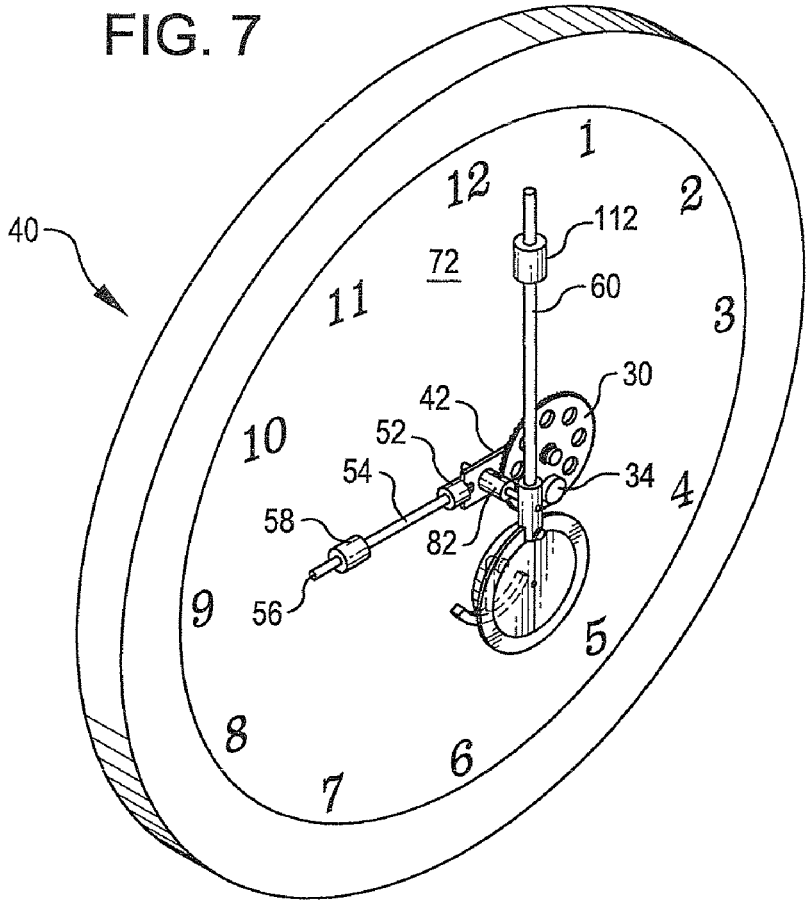
FIG. 7 is a perspective view of a one-movement balanced hands clock, showing both the minute hand and the hour hand mounted on a base, in a representative operational relationship.
Figure 8:
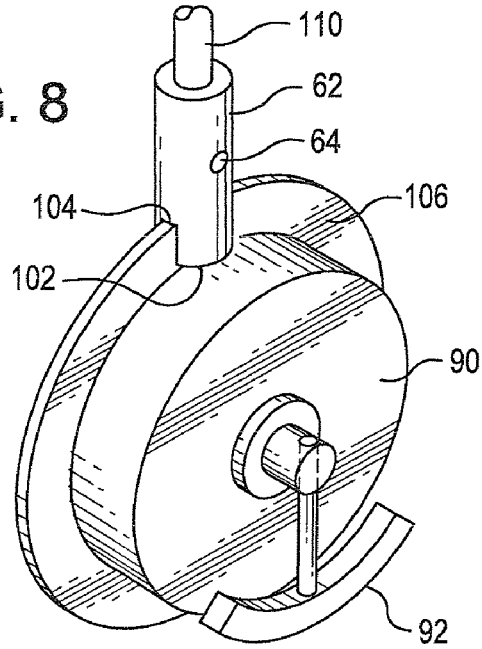
FIG. 8 is a partial perspective view of the reverse side of a minute balanced hand, illustrating the relationship of a mass relative to the movement axis and the movement housing.

The minute hand balancing weight 112 slides on minute arm 110 and is adjusted for the purpose of achieving overall balance of the balanced minute hand 60. The minute hand balancing weight 112 and the hour hand balancing weight 58 may, in an embodiment, be configured to slide on to the minute arm 110 and the hour arm 54, respectively. The minute hand balancing weight 112 and the hour hand balancing weight 58 are used to provide overall balance of the balanced minute hand 60 and the balanced hour hand 42, respectively. Balance adjustments to both the balanced minute hand 60 and the balanced hour hand 42 using the minute hand balancing weight 112 and the hour hand balancing weight 58 are advantageously made after adjustments for eccentricity are completed. When the balance adjustments are made, the balanced minute hand 60 and the balanced hour hand 42 can be placed to indicate the three (3) o'clock or nine (9) o'clock position as indicated by the balanced hour hand 42, and also with the first gear mass 34 and the movement mass 92 aligned so as to point in the direction GR of gravity. FIG. 7 illustrates such a position with respect to the balanced hour hand 42

Turning now to FIG. 11, various details are provided to further illustrate an embodiment of the balanced hour hand 42. Baseplate 44 is the foundation upon which the balanced hour hand 42 is assembled. Gear housing 82 for journaling bearings 86 and 88 has been described above and may be better seen with reference to FIG. 13. However, also mounted to baseplate 44 at aperture 129 (defined by sidewalls $\mathbf{44}_S$ extending between first side $\mathbf{44}_1$ and second side $\mathbf{44}_2$ of baseplate 44) is a second pivot shaft 130. First gear 30 is secured to second pivot shaft 130, for rotary motion thereabout. In an embodiment, the first gear 30 is provided with teeth 132 sized and shaped for gear meshing engagement with teeth 134 on second gear 32. Second pivot shaft 130 defines a pivot axis 140, as noted in FIGS. 11 and 13. In an embodiment, second pivot shaft 130 may be provided as a shaft that is threaded at first $\mathbf{130}_1$ and second $\mathbf{130}_2$ ends. In an embodiment, opposing tapered spacers 142 and 144 are provided to locate bearing 48 for journaling second pivot shaft 130 at a suitable position along pivot axis 140 so that first gear 30 is provided at an appropriate location to engage second gear 32. The tapered format of opposing spacers 142 and 144 may be advantageously utilized to permit the free rotation of the ball bearing 48.

In an embodiment, bearing 48 may have an outer diameter $\mathbf{48}_D$ sized and shaped for insert to and a secure interference pressure fit within sidewalls $\mathbf{30}_S$ that define a central hole $\mathbf{30}_H$ through first gear 30. Fasteners such as nuts 146 and 148 may be utilized to secure the second pivot shaft 130, spacers 142 and 144, and bearing 48 to the baseplate 44.

Attention is again directed to FIG. 11, where connection of the balanced minute hand 60 with the balanced hour hand 42 is illustrated. First pivot shaft 46 is provided along axis 80. Locating washer 150 is provided over an extended portion 66 of second pivot shaft 46. Locating washer 150 may be provided with anti-rotation aperture 152 sized and shaped in conformance with and complementary to the anti-rotation features 68 located on the extended portion 66 of first pivot shaft 46. The just mentioned features also are utilized to locate washer 150 against an upper end stop 154 of first pivot shaft 46, to prevent the balanced minute hand 60 from sliding inward along axis 80 of the first pivot shaft 46. Aperture 64 in connector 62 receives the upper portion 68 of first pivot shaft 46, and a threaded portion 156 extends above connector 62. A nut 158 is utilized to fix the connector 62 and thus the balanced minute hand 60 against locating washer 150, to secure the balanced minute hand 60 in a suitable working position.

Yet further detail is revealed in FIG. 11, where it can be seen that second gear 32 is fixed to the first pivot shaft 46 by way of screw 160. This assures that the second gear 32 rotates with first pivot shaft 46, as also can be appreciated by reference to FIG. 13, where engagement of first gear 30 and second gear 32 may be viewed.

The operational configuration of a one-movement balanced hands clock 40 can be seen in FIG. 6, which shows a one-movement balanced hands clock 40 indicating eight (8) o'clock. The first gear mass 34 and the movement mass 92 are both aligned with gravity forces in the GR direction. A perspective view is provided in FIG. 7, where the clock is indicating nine (9) o'clock.

In an embodiment, a one-movement balanced hands clock 40 exhibits a peculiar behavior. When the balanced minute hand 60 is moved from its balanced position, the balanced minute hand 60 oscillates for a while and ultimately returns to its new balanced position. Such oscillations are transmitted to the balanced hour hand 42. However, if the balanced hour hand 42 is moved from its balanced position, it also oscillates for a while, but its motion does not transmit such oscillations to the balanced minute hand 60.

Attention is now directed to FIGS. 14 through 22, wherein yet another embodiment for a one-movement balanced hands clock 200 is illustrated. The operation of some clocks is carefully designed to apparently defy the laws of nature. One cannot observe them without wondering how they work. In this second embodiment, clock 200, although it uses the same principles as described herein above, the operational mechanisms utilized to achieve the results are hidden from the observer. The base 202 is provided in the form of a clock dial of curved glass, upon which engravings may be etched to provide time indicia as desired. However, utilizing the transparency of glass as base 202, balanced minute hand 204 is on the obverse side $\mathbf{202}_O$ of the glass base 202, and the balanced hour hand assembly 206 is located on the reverse side $\mathbf{202}_R$ of the glass base 202. Also, such a configuration provides a better balance than the cantilever configuration illustrated in FIG. 13. Yet, the same principles are applied to build each of the embodiments, although it will be easily understood, by reference to FIG. 13, that the entire balanced hour hand assembly 206, equivalent to the balanced hour hand assembly 42 shown in FIG. 13, may be moved to the reverse side of base 202 (equivalent to base 72 in FIG. 13) and mounted on first pivot shaft 46, to achieve an equivalent result. However, the journaling or bearing mount 74 shown in FIG. 13 to support first and second ball bearings 76 and 78 is replaced in this embodiment by a plastic journal housing 210 located and assembled in the base 202, but which continues to support first and second ball bearings 76 and 78.

Figure 14:
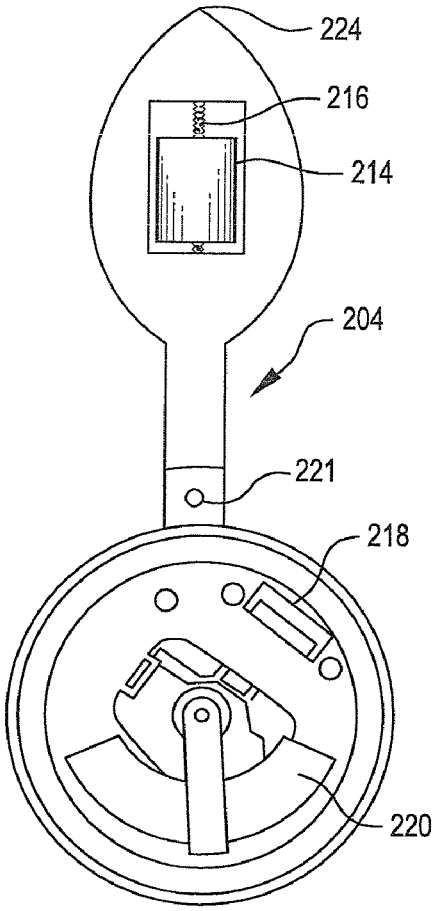
FIG. 14 is a side elevation of a second embodiment of a minute hand for a one-movement balanced hands clock, here showing the reverse side, so that the mass suspended from the movement axis may be seen, as well as the adjustable mass mechanism on the minute arm.

The reverse side of the balanced minute hand assembly 204 is shown in FIG. 14, with minute hand back cover 212 (see FIG. 15) removed. Minute hand balancing weight 214 is provided for movement along threaded shaft 216, for adjustment and balance of the balanced minute hand in the manner described above. Movement 218 with weight 220 is seen in this FIG. 14. A pivot axis location 221 is provided, and it functions in the same manner as aperture 64 pivot axis 80 location in balanced minute hand 60 as described above.

Figure 16:
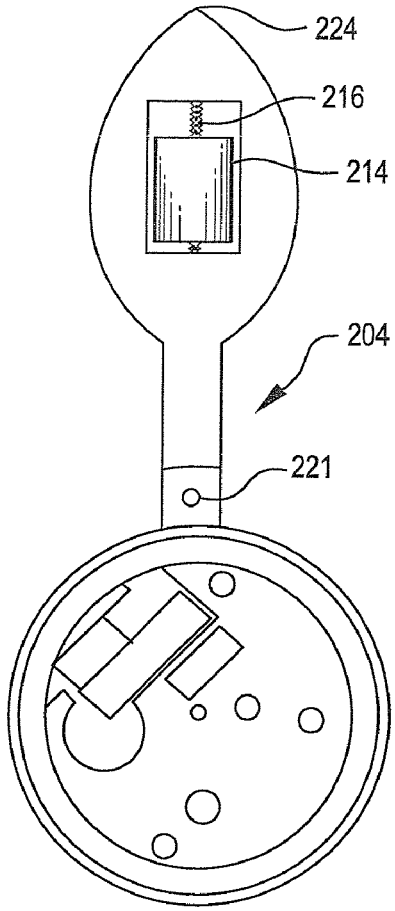
FIG. 16 provides is a side elevation of the obverse side of a minute hand for a one-movement balanced hands clock, showing the movement nested in a movement compartment, as well as the adjustable mass mechanism on the minute arm.
Figure 15:
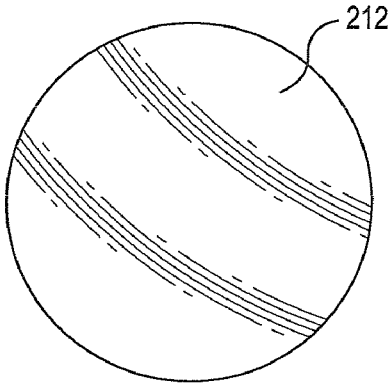
FIG. 15 provides an illustration of a reverse side cover for the minute hand to cover the reverse side of the movement compartment in the minute hand.
Figure 17:
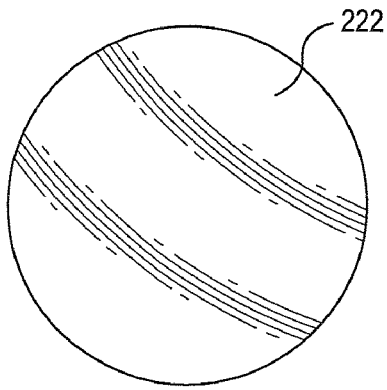
FIG. 17 provides an illustration of an obverse side cover for the minute hand to cover the obverse side of the movement compartment.

The obverse side of the balanced minute hand assembly 204 is shown in FIG. 16, with the minute hand back cover 222 (see FIG. 17) removed. In this design, an artistic leaf shaped design is provided for the point or indicating end 224 of the balanced minute hand 204.

Figure 18:
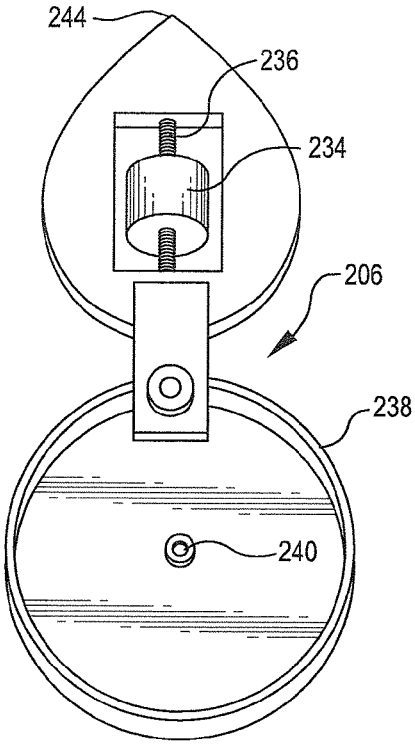
FIG. 18 illustrates the hour hand for a second embodiment of a one-movement balanced hands clock, here showing the reverse side, showing the gear compartment that houses the large gear and mass in the hour hand, as well as showing the adjustable mass mechanism on the hour arm.
Figure 20:
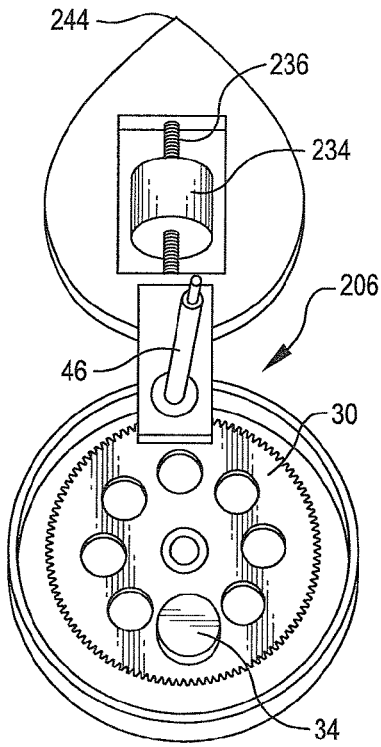
FIG. 20 illustrates the hour hand for the second embodiment of a one-movement balanced hands clock, as just provided in FIG. 18, providing a view of the gear and mass in the gear compartment, as well as the first pivot shaft, and an adjustable mass mechanism on the hour arm.
Figure 19:
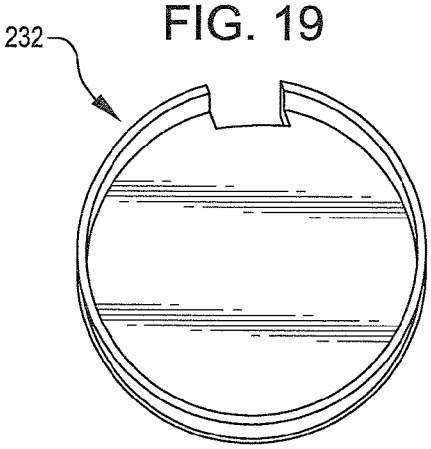
FIG. 19 provides an illustration of an inside reverse side cover for the hour hand, to cover the reverse side of the gear compartment in the hour hand.
Figure 21:
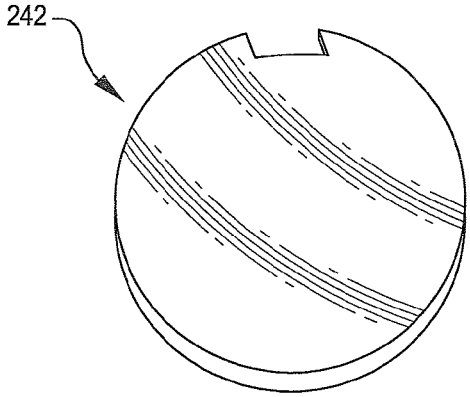
FIG. 21 provides an illustration of an outside reverse side cover for the hour hand, to cover the reverse side of the gear compartment in the hour hand.
Figure 22:
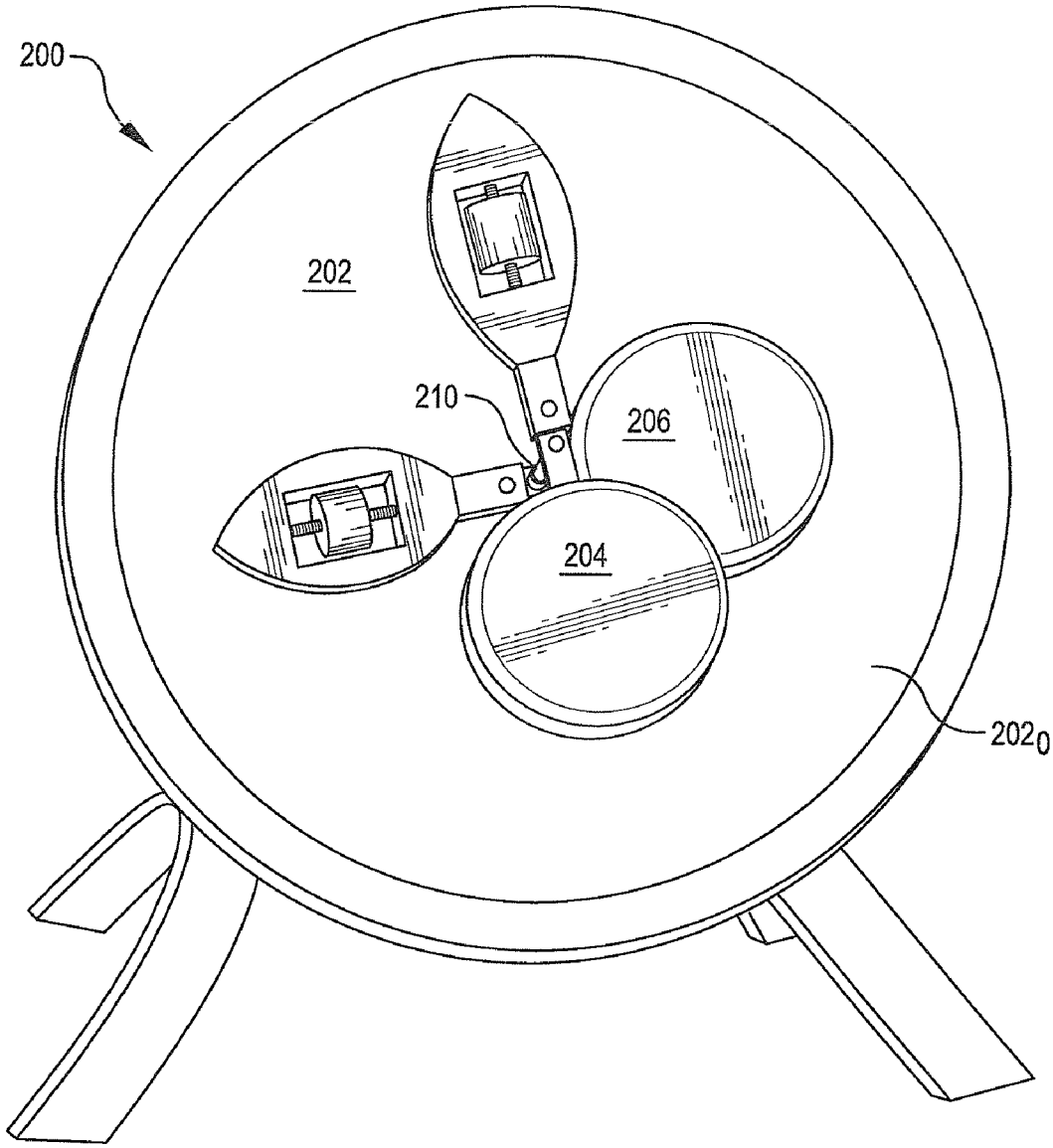
FIG. 22 illustrates a the fully assembled second embodiment of a one-movement balanced hands clock, showing the balanced minute hand and the balanced hour hand mounted on a see-through base, and also showing a stand for supporting the base.

The reverse side of the balanced hour hand assembly 206 is shown in FIG. 18, with hour hand back cover 232 (inside view), (see FIG. 19), removed. Hour hand balancing weight 234 is provided for movement along threaded shaft 236, for adjustment and balance of the balanced hour hand in the manner described above. First gear 30 with weight or first gear mass 34 is seen in FIG. 20, whereas the first gear 30 is removed from the housing 238 in FIG. 18. A pivot axis location 240 is provided, and it functions in the same manner as provided along pivot axis 140 for the second pivot shaft 130 in the balanced hour hand 42 as described above.

The reverse side of the balanced hour hand assembly 206 is shown in FIG. 20, with the hour hand back cover 242 (outside view), (see FIG. 21), removed. In this design, an artistic leaf shaped design is provided for the point or indicating end 244 of the balanced hour hand 206.

It is to be appreciated that the various aspects, features, structures, and embodiments of a one-movement balanced hands clock as described herein is a significant improvement in the state of the art. The clock design is simple, reliable, and easy to use. Although only a few exemplary aspects and embodiments have been described in detail, various details are sufficiently set forth in the drawing figures and in the specification provided herein to enable one of ordinary skill in the art to make and use the invention(s), which need not be further described by additional writing.

Importantly, the aspects, features, structures, and embodiments described and claimed herein may be modified from those shown without materially departing from the novel teachings and advantages provided, and may be embodied in other specific forms without departing from the spirit or essential characteristics thereof. Therefore, the various aspects and embodiments presented herein are to be considered in all respects as illustrative and not restrictive. As such, this disclosure is intended to cover the structures described herein and not only structural equivalents thereof, but also equivalent structures. Numerous modifications and variations are possible in light of the above teachings. The scope of the invention, as described herein is thus intended to include variations from the various aspects and embodiments provided which are nevertheless described by the broad meaning and range properly afforded to the language herein, as explained by and in light of the terms included herein, or the legal equivalents thereof.

The invention claimed is:

1. A clock, said clock comprising:

a body;

a first pivot shaft, said first pivot shaft rotatably extending from said body;

a minute hand, said minute hand fixedly secured to said first pivot shaft for rotary movement in concert therewith;

an hour hand, said hour hand rotatably secured to and operably balanced about said first pivot shaft, said hour hand further comprising a baseplate, a second pivot shaft, spaced outward along said hour hand away from said first pivot shaft, said second pivot shaft secured to said baseplate, a first gear, said first gear rotatably mounted with respect to said second pivot shaft, said first gear further comprising a first gear mass provided at a selected first gear mass orientation position with respect to said first gear, said first gear mass providing torque on said first gear about said second pivot shaft responsive to the location of said first gear mass during rotation of said first gear about said second pivot shaft;

a second gear, said second gear affixed to and rotating in concert with said first pivot shaft, said second gear operably driving said first gear, said first gear mass maintaining or moving said first gear by gravity in a direction wherein said first gear mass remains positioned downward as said second gear orbits around said first gear;

a single clock movement, said single clock movement mounted to said minute hand, said single clock movement configured to drive movement of said minute hand; and wherein said minute hand drives movement of said hour hand.

2. The clock as set forth in claim 1, wherein said second gear is adjustably and detachably affixed to said first pivot shaft.

3. The clock as set forth in claim 1, wherein said first gear and said second gear each comprise toothed gears.

4. The clock as set forth in claim 3, wherein the gear ratio R, being the number of teeth in said first gear divided by the number of teeth in said second gear, is eleven (11).

5. The clock as set forth in claim 4, further comprising a journal assembly, and wherein said first pivot shaft is journaled for rotary motion through said journal assembly.

6. The clock as set forth in claim 5, further comprising a first pair of ball bearings, said first pair of ball bearings sized and shaped for accommodating said first pivot shaft, and adapted to provide friction minimizing passage of said first pivot shaft through said journal assembly.

7. The clock as set forth in claim 1, wherein said second pivot shaft is journaled for rotary movement of said first gear about said second pivot shaft.

8. The clock as set forth in claim 7, wherein a first gear bearing is provided for journaling said second pivot shaft, and wherein said first gear bearing comprises a ball bearing.

9. The clock as set forth in claim 1, wherein said first pivot shaft is journaled in said body for pivoting movement within a bearing mount.

10. The clock as set forth in claim 1, wherein said hour hand further comprises a connector and a hour hand arm, and wherein said hour hand arm extends outwardly from said connector to a distal end.

11. The clock as set forth in claim 10, further comprising an hour arm adjustable weight, said hour arm adjustable weight moveable distally or proximally along said hour hand arm to provide balance adjustment for said hour hand.

12. The clock as set forth in claim 11, wherein said hour hand arm is cylindrical with an external diameter.

13. The clock as set forth in claim 11, wherein said hour arm adjustable weight comprises an annular cylindrical shape having an inside diameter, said inside diameter of said hour arm adjustable weight complementary in size to said external diameter of said hour hand arm, wherein said adjustable weight may be adjustably secured along said hour hand arm.

14. The clock as set forth in claim 1, wherein said minute hand comprises an indicating end, a movement end, and a minute hand arm therebetween, and wherein said single clock movement is located at said movement end.

15. The clock as set forth in claim 1, wherein said single clock movement comprises an electronic movement.

16. The clock as set forth in claim 1, wherein said single clock movement comprises a mechanical movement.

17. The clock as set forth in claim 1, further comprising a first gear cover, said first gear cover comprising a compartment containing said first gear and obscuring from view said first gear.

18. The clock as set forth in claim 17, wherein said first gear cover comprises a removable first gear cover cap.

19. The clock as set forth in claim 1, further comprising a movement cover, said movement cover comprising a movement compartment containing said single clock movement and obscuring said single clock movement from view.

20. The clock as set forth in claim 19, wherein said movement cover comprises a removable movement cover cap.

21. The clock as set forth in claim 1, wherein said base comprises an indicating surface, said indicating surface oriented substantially vertically.

22. The clock as set forth in claim 21, further comprising a base support, said base support adapted to support said base in a vertical orientation.

23. The clock as set forth in claim 1, wherein said base comprises a see-through material.

24. The clock as set forth in claim 1, wherein said base comprises a face having a visible time display.

25. A clock, said clock comprising:

a body;

a first pivot shaft, said first pivot shaft rotatably extending from said body;

a minute hand, said minute hand fixedly secured to said first pivot shaft for rotary movement in concert therewith;

an hour hand, said hour hand rotatably secured to and operably balanced about said first pivot shaft, said hour hand further comprising a baseplate, a second pivot shaft, said second pivot shaft spaced outward along said hour hand away from said first pivot shaft, said second pivot shaft fixed to said baseplate, a first gear, said first gear rotabably secured for movement about said second pivot shaft, said first gear further comprising first gear mass, said first gear mass affixed to said first gear at a selected first gear orientation position, said first gear mass providing torque on said first gear about said second pivot shaft responsive to the location of said first gear mass during rotation of said first gear about said second pivot shaft;

a second gear, said second gear affixed to and rotating in concert with said first pivot shaft, said second gear operably driving said first gear, said first gear and said second gear each comprising toothed gears wherein a gear ratio R, being the number of teeth in said first gear divided by the number of teeth in said second gear, is eleven (11);

said first gear mass and said second gear juxtaposed to provide that said first gear mass maintains or moves said first gear by gravity in a direction wherein said first gear mass remains positioned downward as said second gear orbits around said first gear;

a single clock movement, said single clock movement mounted to said minute hand, said single clock movement configured to drive movement of said minute hand; and wherein said minute hand drives movement of said hour hand.

26. The clock as set forth in claim 25, further comprising a gear housing, said gear housing affixed to said baseplate, and wherein said first pivot shaft is journaled for rotary movement through said gear housing.

27. The clock as set forth in claim 25, further comprising a first pair of ball bearings, said first pair of ball bearings sized and shaped for accommodating said first pivot shaft, and adapted to provide friction minimizing passage of said first pivot shaft through said gear housing.

28. The clock as set forth in claim 25, wherein a first gear bearing is provided for journaling said second pivot shaft, and wherein said first gear bearing comprises a ball bearing.

29. The clock as set forth in 25, further comprising an hour arm adjustable weight, said hour arm adjustable weight moveable distally or proximally along said hour hand arm to provide balance adjustment for said hour hand.

30. The clock as set forth in claim 25, wherein said single clock movement comprises an electronic movement.

* * * * *

UNITED STATES PATENT AND TRADEMARK OFFICE

CERTIFICATE OF CORRECTION

PATENT NO. : 7,643,381 B2
APPLICATION NO. : 12/018798
DATED : January 5, 2010
INVENTOR(S) : Rubens A. Sigelmann It is certified that error appears in the above-identified patent and that said Letters Patent is hereby corrected as shown below:

On the cover page, under "OTHER PUBLICATIONS", third line, delete "("NWACC")" and substitute therefore --("NAWCC")--.

On the cover page, under "OTHER PUBLICATIONS", fourth line, delete "NAWACC" and substitute therefore --NAWCC--.

IN THE SPECIFICATION:

Column 2, line 15, after the words "in the minute hand 10, and", delete "a".

Column 2, line 35, after the words "balanced hour hand is moveable", insert --with--.

Signed and Sealed this
Eighth Day of November, 2011

David J. Kappos

David J. Kappos
*Director of the United States Patent and Trademark Office*